US011847963B2

(12) United States Patent
Zheng

(10) Patent No.: US 11,847,963 B2
(45) Date of Patent: Dec. 19, 2023

(54) DRIVING CIRCUIT AND DISPLAY APPARATUS

(71) Applicant: CHONGQING KONKA PHOTOELECTRIC TECHNOLOGY RESEARCH INSTITUTE CO., LTD., Chongqing (CN)

(72) Inventor: Shisong Zheng, Chongqing (CN)

(73) Assignee: CHONGQING KONKA PHOTOELECTRIC TECHNOLOGY RESEARCH INSTITUTE CO., LTD., Chongqing (CN)

( * ) Notice: Subject to any disclaimer, the term of this patent is extended or adjusted under 35 U.S.C. 154(b) by 0 days.

(21) Appl. No.: 17/263,905

(22) PCT Filed: Jan. 20, 2020

(86) PCT No.: PCT/CN2020/073081
§ 371 (c)(1),
(2) Date: Jan. 28, 2021

(87) PCT Pub. No.: WO2021/142858
PCT Pub. Date: Jul. 22, 2021

(65) Prior Publication Data

US 2022/0343839 A1 Oct. 27, 2022

(30) Foreign Application Priority Data

Jan. 17, 2020 (CN) ..... 202010052648.9

(51) Int. Cl.
*G09G 3/3225* (2016.01)

(52) U.S. Cl.
CPC ... *G09G 3/3225* (2013.01); *G09G 2300/0852* (2013.01); *G09G 2310/061* (2013.01); *G09G 2320/0233* (2013.01)

(58) Field of Classification Search
CPC ..... G09G 3/3225; G09G 3/3233; G09G 3/32; G09G 3/3216; G09G 2300/0852;
(Continued)

(56) References Cited

U.S. PATENT DOCUMENTS

2012/0242712 A1 9/2012 Ko et al.
2015/0364082 A1* 12/2015 Gu ..... G09G 3/3225 345/76

(Continued)

FOREIGN PATENT DOCUMENTS

CN 104252845 A 12/2014
CN 104599637 A 5/2015

(Continued)

*Primary Examiner* — David Tung
(74) *Attorney, Agent, or Firm* — Gang Yu

(57) ABSTRACT

The disclosure discloses a driving circuit and a display apparatus, wherein the driving circuit includes a substrate circuit and at least one standby circuit, and the at least one standby circuit is connected with the substrate circuit; the substrate circuit includes a first light-emitting device, a first driving unit and a first capacitor unit; the first driving unit is respectively connected with the first light-emitting device and the first capacitor unit; the first capacitor unit is charged through the first driving unit until a voltage value of the first capacitor unit meets a compensation voltage value of the first driving unit; after the charging of the first capacitor unit is completed, a first reference potential is coupled with the first capacitor unit to enable the first driving unit to obtain an adjustable trans-voltage, and the first driving unit outputs a stable current according to the adjustable trans-voltage to drive the first light-emitting device to work. The disclosure improves the brightness uniformity problem caused by voltage drop, thereby improving the picture quality of the display.

18 Claims, 10 Drawing Sheets

(58) Field of Classification Search
CPC ... G09G 2300/0819; G09G 2300/0842; G09G 2300/0861; G09G 2310/061; G09G 2310/0251; G09G 2320/0233; G09G 2320/0223
See application file for complete search history.

(56) References Cited

U.S. PATENT DOCUMENTS

| | | | | |
|---|---|---|---|---|
| 2018/0047337 | A1* | 2/2018 | Zhu | G09G 3/3233 |
| 2018/0182296 | A1* | 6/2018 | Wang | G09G 3/3208 |
| 2019/0340979 | A1* | 11/2019 | Yang | G09G 3/3233 |

FOREIGN PATENT DOCUMENTS

| | | | |
|---|---|---|---|
| CN | 106910468 | A | 6/2017 |
| CN | 107093401 | A | 8/2017 |

* cited by examiner

DRIVING CIRCUIT AND DISPLAY APPARATUS

TECHNICAL FIELD

The disclosure relates to the technical field of display, in particular to a driving circuit and a display apparatus.

BACKGROUND

Electroluminescence (EL) devices include organic light-emitting diodes (OLEDs), light-emitting diodes (LEDs), etc. EL devices have been widely used in the manufacture of display products in recent years. Compared with devices in the related art such as cathode ray tubes (CRTs) displays, liquid crystal displays (LCDs), EL device applications exhibit better optical characteristics, lower power consumption performance, and better product formability. As the EL device is driven by current, when the EL device is used for manufacturing a display, a typical active matrix (AM) or passive matrix (PM) driving method is matched, and a large electric load caused by current passing, through a circuit and the EL device inevitably generates an IR-drop problem, and the voltage drop problem causes a drop in the voltage value so that the voltage value deviates from the supply voltage value of the original voltage source, which directly causes a reduction in the drive trans-voltage of the EL device, thereby affecting a drop in the current flowing through the EL device, finally causing a reduction in the brightness of the EL device, reflecting a reduction in the brightness uniformity of the display panel, resulting in a reduction in the picture quality of the display.

As shown in FIG. 1, according to a typical display driving method and circuit design, since a common power supply is adopted, except for pixel points at the edge of a panel, pixels in a display area are supplied with power, direct wiring is conducted through the circuit, and when an EL device is operated to emit light, a large electric load is provided, so that different voltage drops can be generated at the pixel points in the display area, the direct drop of brightness is reflected, and the brightness uniformity is deteriorated. Refer to FIGS. 2 and 3 for details: where the voltage drop is due to the electrical load on the series path of the line, i.e., the voltage at the VSS point will be less than the voltage at the first pixel point, VSS1, the voltage of the first pixel, VSS1, is less than the voltage of the second pixel, VSS2. The voltage drop in the path of the VDD causes a trans-voltage drop across the EL device, and further causes a current drop across the EL device, i. e. the current of the first pixel, I1, is greater than the current of the second pixel, I2, because the EL device is illuminated by electric current, the decrease of electric current across the EL device will cause the direct brightness of the EL device change, that is, the brightness of the first pixel will be larger than the brightness of the second pixel, thus leading to the brightness uniformity deterioration, this leads to a deterioration in the quality of the display.

Accordingly, the related art has yet to be improved and developed.

SUMMARY

In view of the above-mentioned deficiencies of the related art, it is an object of the present disclosure to provide a driving circuit and a display apparatus to solve the problem that the picture quality of a display is degraded due to the voltage drop of an EL device.

The technical scheme of the disclosure is as follows:

According to one embodiment of the disclosure, a driving circuit is provided, the driving circuit includes a substrate circuit and at least one standby circuit, wherein the at least one standby circuit is connected with the substrate circuit; the substrate circuit includes a first light-emitting device, a first driving unit and a first capacitor unit; the first driving unit is respectively connected with the first light-emitting device and the first capacitor unit; the first capacitor unit is charged through the first driving unit until a voltage value of the first capacitor unit meets a compensation voltage value of the first driving unit; after the charging of the first capacitor unit is completed, a first reference potential is coupled with the first capacitor unit to enable the first driving unit to obtain a first adjustable trans-voltage, and the first driving unit outputs a stable current according to the first adjustable trans-voltage to drive the first light-emitting device to work;

the standby circuit includes a second light-emitting device, a second driving unit and a second capacitor unit, and the second light-emitting device is respectively connected with the second driving unit and the second capacitor unit; the second capacitor unit is connected with the first capacitor unit; the second capacitor unit is charged through the second driving unit until a voltage value of the second capacitor unit meets a compensation voltage value of the second driving unit; after the charging of the second capacitor unit is completed, the first reference potential is coupled with the second capacitor unit to enable the second driving unit to obtain a second adjustable trans-voltage, and the second driving unit outputs a stable current according to the second adjustable trans-voltage to drive the second light-emitting device to work.

Further arrangement of the disclosure, the first driving unit includes a first transistor, a first end of the first transistor is connected with a cathode of the first light-emitting device, a second end of the first transistor is connected with a negative electrode of a power supply, and a gate end of the first transistor is connected with the first capacitor unit.

Further arrangement of the disclosure, the first capacitor unit includes a first capacitor, a first end of the first capacitor is connected with the gate of the first transistor, and a second end of the first capacitor is connected with the second capacitor unit.

Further arrangement of the disclosure, the substrate circuit further includes a first reset unit, wherein the first reset unit is connected with the first driving unit and is configured to receive the first reference potential and reset the first driving unit according to a first control signal.

Further arrangement of the disclosure, the first reset unit includes a second transistor, a first end of the second transistor is connected with a first reference potential line and used for receiving a first reference potential, a second end of the second transistor is connected with the first driving unit, and a gate of the second transistor is connected with a first control signal line and used for receiving the first control signal.

Further arrangement of the disclosure, the substrate circuit further includes a third transistor and a fourth transistor; a first end of the third transistor is connected with the first driving unit, the second end of the third transistor is connected with a first end of the fourth transistor, a second end of the fourth transistor is connected with the first capacitor unit, and the gate of the third transistor and the gate of the fourth transistor are respectively connected with a second control signal line and used for receiving a second control signal.

Further arrangement of the disclosure, the substrate circuit further includes a fifth transistor, a first end of the fifth transistor is connected with the first capacitor unit and the second capacitor unit, a second end of the fifth transistor is connected with a second reference potential line and used for receiving a second reference potential, and a gate of the fifth transistor is connected with a second control signal line and used for receiving a second control signal.

Further arrangement of the disclosure, the substrate circuit further includes a sixth transistor and a seventh transistor; a first end of the sixth transistor is connected with a first reference potential line and used for receiving the first reference potential, a second end of the sixth transistor is connected with the first end of the fifth transistor and the first capacitor unit, and a gate of the sixth transistor is connected with a third control signal line and used for receiving a third control signal; a first end of the seventh transistor is connected with a cathode of the first light-emitting device, a second end of the seventh transistor is connected with the first end of the third transistor and the first driving unit, and a gate of the seventh transistor is connected with the third control signal line and used for receiving the third control signal.

Further arrangement of the disclosure, the substrate circuit further includes an eighth transistor, a first end of the eighth transistor is connected with a cathode of the first light-emitting device, a second end of the eighth transistor is connected with the first driving unit, and a gate of the eighth transistor is connected with a fourth control signal line and is used for receiving a fourth control signal.

Further arrangement of the disclosure, the second driving unit includes a ninth transistor, a first end of the ninth transistor is connected with a cathode of the second light-emitting device, a second end of the ninth transistor is connected with a negative electrode of a power supply, and a gate of the ninth transistor is connected with the second capacitor unit.

Further arrangement of the disclosure, the second capacitor unit includes a second capacitor, a first end of the second capacitor is connected with the gate of the ninth transistor, and a second end of the second capacitor is connected with the first capacitor unit.

Further arrangement of the disclosure, the standby circuit further includes a second reset unit, wherein the second reset unit is connected with the second driving unit and the second reset unit is used for receiving the first reference potential and resetting the second driving unit according to a first control signal.

Further arrangement of the disclosure, the second reset unit includes a tenth transistor, a first end of the tenth transistor is connected with a first reference voltage line and used for receiving a first reference voltage, a second end of the tenth transistor is connected with the second driving unit, and a gate of the tenth transistor is connected with a first control signal line and used for receiving a first control signal.

Further arrangement of the disclosure, the standby circuit further includes an eleventh transistor and a twelfth transistor, a first end of the eleventh transistor is connected with a second end of the twelfth transistor, a first end of the twelfth transistor is respectively connected with the second driving unit and the second capacitor unit, and a gate of the eleventh transistor and a gate of the twelfth transistor are respectively connected with a second control signal line and used for receiving a second control signal.

Further arrangement of the disclosure, the standby circuit further includes a thirteenth transistor and a fourteenth transistor; a first end of the thirteenth transistor is connected with a second end of the fourteenth transistor, a second end of the thirteenth transistor is connected with the first end of the ninth transistor and the second end of the eleventh transistor, a gate of the thirteenth transistor is connected with a third control signal line and is used for receiving a third control signal, and the first end of the fourteenth transistor is connected with the cathode of the second light-emitting device; the gate of the fourteenth transistor is connected with a fifth control signal line and used for receiving a fifth control signal, and an anode of the second light-emitting device is connected with the positive electrode of the power supply.

According to one embodiment of the disclosure, a display apparatus is provided, the display apparatus includes a display panel and a driving circuit, wherein the driving circuit is arranged on the display panel, wherein the driving circuit includes a substrate circuit and at least one standby circuit connected with the substrate circuit; wherein the substrate circuit includes a first light-emitting device, a first driving unit and a first capacitor unit; the first driving unit is respectively connected with the first light-emitting device and the first capacitor unit; the first capacitor unit is charged through the first driving unit until a voltage value of the first capacitor unit meets a compensation voltage value of the first driving unit; after the charging of the first capacitor unit is completed, a first reference potential is coupled with the first capacitor unit to enable the first driving unit to obtain a first adjustable trans-voltage, and the first driving unit outputs a stable current according to the first adjustable trans-voltage to drive the first light-emitting device to work; the standby circuit includes a second light-emitting device, a second driving unit and a second capacitor unit, and the second light-emitting device is respectively connected with the second driving unit and the second capacitor unit; the second capacitor unit is connected with the first capacitor unit; the second capacitor unit is charged through the second driving unit until a voltage value of the second capacitor unit meets a compensation voltage value of the second driving unit; after the charging of the second capacitor unit is completed, the first reference potential is coupled with the second capacitor unit to enable the second driving unit to obtain a second adjustable trans-voltage, and the second driving unit outputs a stable current according to the second adjustable trans-voltage to drive the second light-emitting device to work.

The disclosure provides a driving circuit and a display apparatus, wherein the driving circuit includes a substrate circuit and at least one standby circuit, and the at least one standby circuit is connected with the substrate circuit; the substrate circuit includes a first light-emitting device, a first driving unit and a first capacitor unit; the first driving unit is respectively connected with the first light-emitting device and the first capacitor unit; the first capacitor unit is charged through the first driving unit until a voltage value of the first capacitor unit meets a compensation voltage value of the first driving unit; after the charging of the first capacitor unit is completed, a first reference potential is coupled with the first capacitor unit to enable the first driving unit to obtain a first adjustable trans-voltage, and the first driving unit outputs a stable current according to the first adjustable trans-voltage to drive the first light-emitting device to work; the standby circuit includes a second light-emitting device, a second driving unit and a second capacitor unit, and the second light-emitting device is respectively connected with the second driving unit and the second capacitor unit; the second capacitor unit is connected with the first capacitor unit; the second capacitor unit is charged through the second driving unit until a voltage value of the second capacitor unit meets a compensation voltage value of the second driving unit; after the charging of the second capacitor unit is completed, the first reference potential is coupled with the second capacitor unit to enable the second driving unit to obtain a second adjustable trans-voltage, and the second driving unit outputs a stable current according to the second adjustable trans-voltage to drive the second light-emitting device to work. The disclosure improves the brightness uniformity problem caused by voltage drop, thereby improving the picture quality of the display.

BRIEF DESCRIPTION OF THE DRAWINGS

In order to explain the embodiments of the present disclosure or the technical solutions in the related art more clearly, the following will briefly introduce the drawings that need to be used in the description of the embodiments or the related art. Obviously, the drawings in the following description are only some embodiments of the present disclosure, for a person skilled in the art, other figures can be obtained from the structures shown in these figures without involving any inventive effort.

DETAILED DESCRIPTION OF THE EMBODIMENTS

Figure 1:
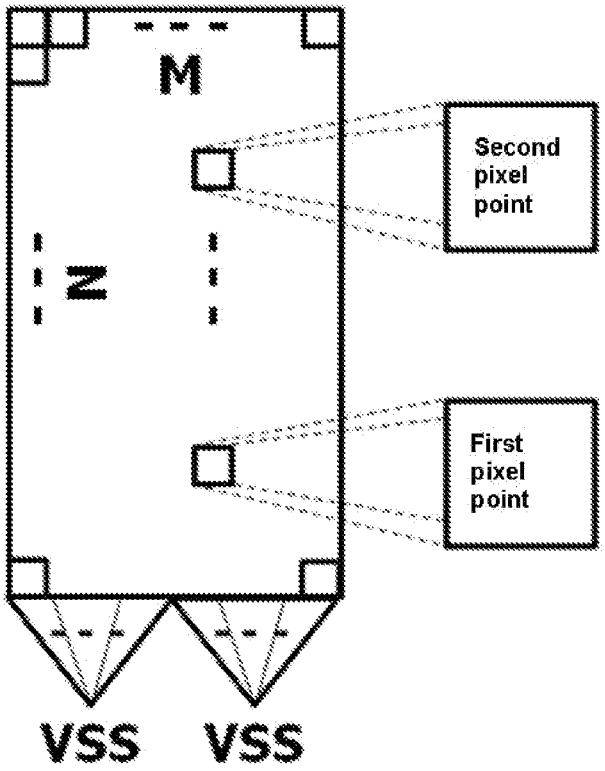
FIG. 1 is a schematic diagram showing the layout of a pixel point in the conventional art.
Figure 2:
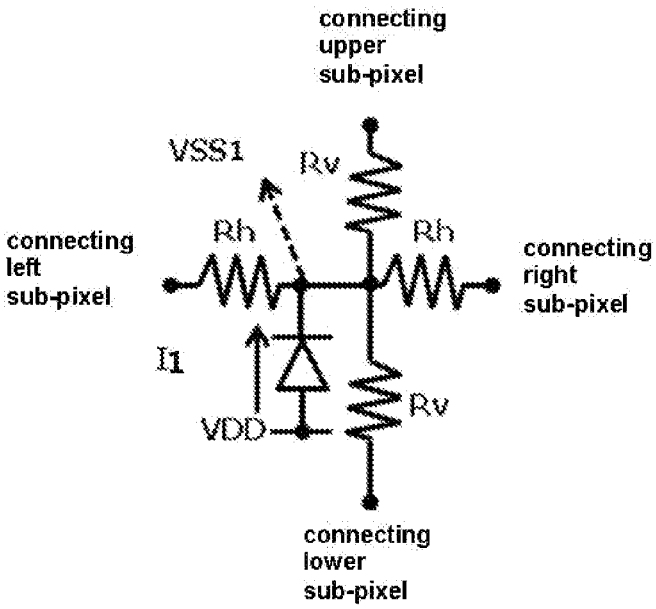
FIG. 2 is a schematic circuit diagram 1 of a pixel in the conventional art.
Figure 3:
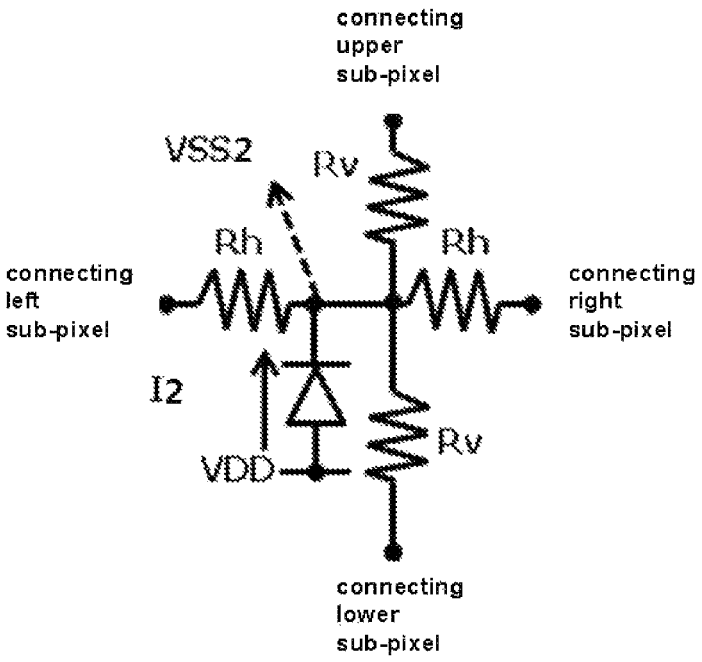
FIG. 3 is a schematic circuit diagram 2 of a pixel in the conventional art.

The inventors have found that in the AM or PM driving mode of a typical EL display, the brightness uniformity decreases due to the voltage drop effect generated by its nature. In addition, for the specification requirement of higher resolution, the defect of insufficient overall performance is more prominent, more light-emitting devices need to be arranged, and the charging time of a single light-emitting device is reduced due to the increase of the light-emitting devices needing to be controlled. In the driving circuit and the display apparatus provided by the disclosure, the driving circuit includes a substrate circuit, and the substrate circuit can be connected with one or more standby circuits, so that the present disclosure can realize synchronous driving of multiple light-emitting devices by accumulating standby circuits on the basis of compensating the light-emitting devices. Therefore, the present disclosure improves the brightness uniformity caused by the voltage drop to improve the picture quality of the display, and can simultaneously control the light emission of multiple light-emitting devices, under the same charging time, the driving feasibility of the display resolution is improved, so as to improve the resolution of the display. In order to make the objectives, technical solutions and effects of the present disclosure clearer, the present disclosure will be further described in detail below with reference to the accompanying drawings and examples. It is to be understood that the specific embodiments described herein are merely illustrative of the present disclosure and are not intended to be limiting thereof.

In the embodiments and claims, the articles "a", "an" and "the" may refer broadly to a single or a plurality, unless the context clearly dictates otherwise.

In addition, if a description of "first", "second", etc. is referred to in embodiments of the present disclosure, the description of "first", "second", etc. is used for descriptive purposes only and is not to be construed as indicating or implying relative importance or implicitly indicating the number of technical features indicated. Thus, features defining "first" and "second" may explicitly or implicitly include at least one such feature. In addition, the technical solutions between the various embodiments can be combined with each other, but it must be based on what can be achieved by a person skilled in the art. When the combination of technical solutions is contradictory or cannot be achieved, the combination of the technical solutions should not be considered to exist, nor be within the scope of protection of the present disclosure.

Referring also to FIGS. 4-15, the present disclosure provides an exemplary embodiment of a driving circuit. In one embodiment, the driving circuit corresponds to an $N^{th}$ column of pixel units of a pixel array of the display apparatus.

Referring to FIGS. 4, 5, 6 and 7, a driving circuit includes a substrate circuit 100 and at least one standby circuit 200, wherein the at least one standby circuit 100 is connected with the substrate circuit 200. In the embodiment, the substrate circuit 100 includes a first light-emitting device 101, a first driving unit 102, a first capacitor unit 103 and a first reset unit 104. Specifically, the first driving unit 102 is connected with the first light-emitting device 101 and the first capacitor unit 103, respectively. The first capacitor unit 103 is charged through the first driving unit 102 until a voltage value of the first capacitor unit meets a compensation voltage value of the first driving unit 102, after the charging of the first capacitor unit 103 is completed, a first reference potential is coupled with the first capacitor unit to enable the first driving unit 102 to obtain a first adjustable trans-voltage and the first driving unit 102 outputs a stable current according to the first adjustable trans-voltage to drive the first light-emitting device 101 to work. Further, the standby circuit 200 includes a second light-emitting device 201, a second driving unit 202, a second capacitor unit 203 and a second reset unit 204, the second light-emitting device 201 is connected with the second driving unit 202 and the second capacitor unit 203, respectively, and the second capacitor unit 203 is connected with the first capacitor unit 103. The second capacitor unit 203 is charged through the second driving unit 202 until a voltage value of the second capacitor unit meets a compensation voltage value of the second driving unit 202; after the charging of the second capacitor unit 203 is completed, the first reference potential is coupled with the second capacitor unit 203 to enable the second driving unit 202 to obtain a second adjustable trans-voltage, and the second driving unit 202 outputs a stable current according to the second adjustable trans-voltage to drive the second light-emitting device 201 to work.

Through the above technical solution, the present disclosure can realize synchronous driving of multiple light-emitting devices by accumulating standby circuits on the basis of compensating the light-emitting devices. Therefore, the present disclosure improves the brightness uniformity caused by the voltage drop to improve the picture quality of the display, and can simultaneously control the light emission of multiple light-emitting devices, under the same charging time, the driving feasibility of the display resolution is improved, so as to improve the resolution of the display.

It should be noted that the first light-emitting device and the second light-emitting device may be a micro light-emitting diode (MLED) or an organic light-emitting diode (OLED), but not limited thereto, components driven by electric current are within the scope of the disclosure.

Figure 4:
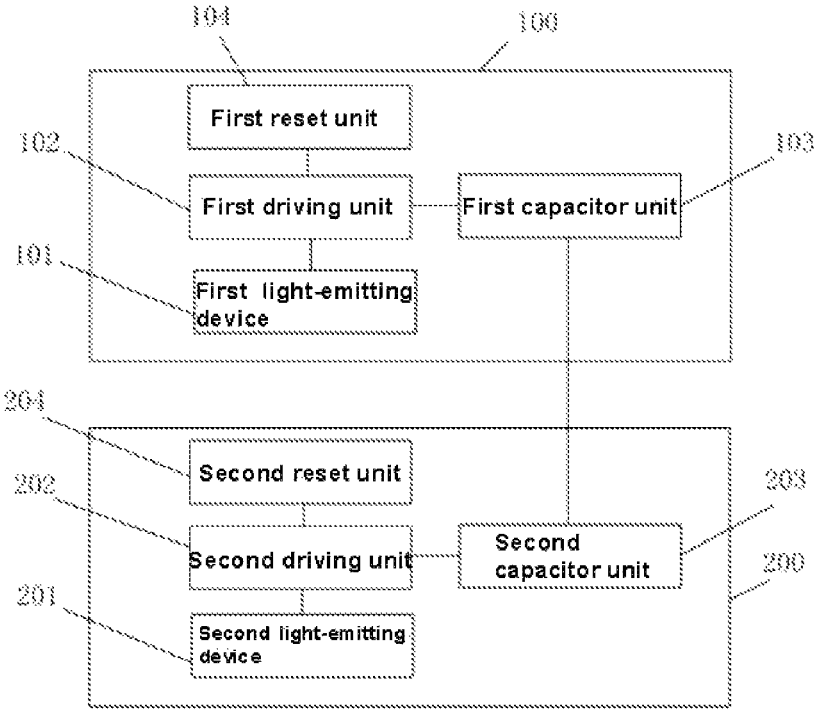
FIG. 4 is a functional block schematic diagram of the driving circuit of the present disclosure.
Figure 5:
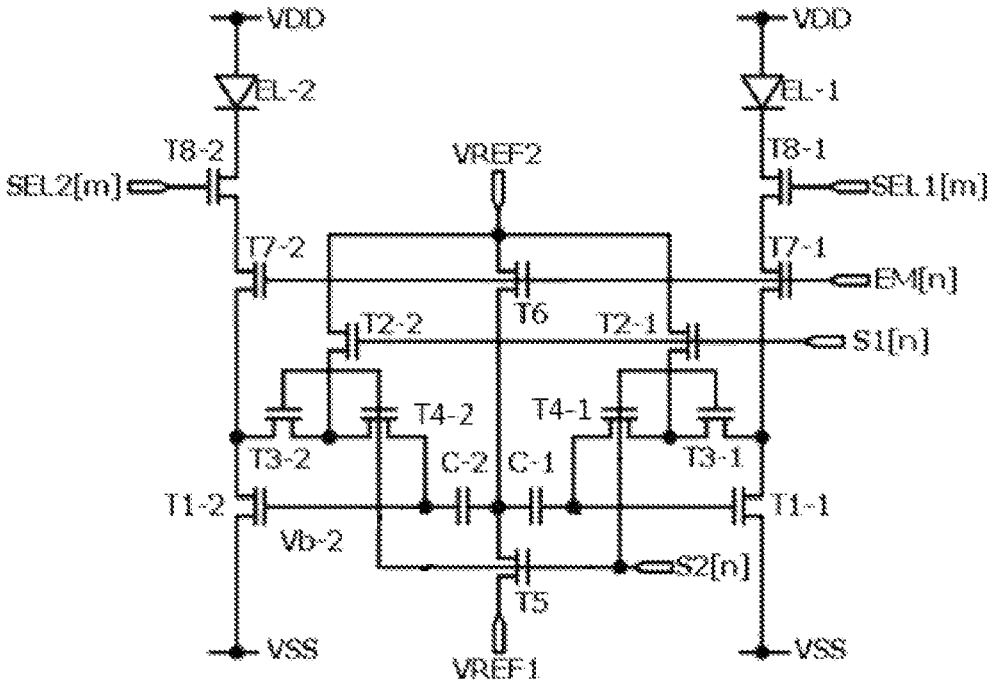
FIG. 5 is a schematic diagram showing the structure of the driving circuit of the present disclosure.
Figure 6:
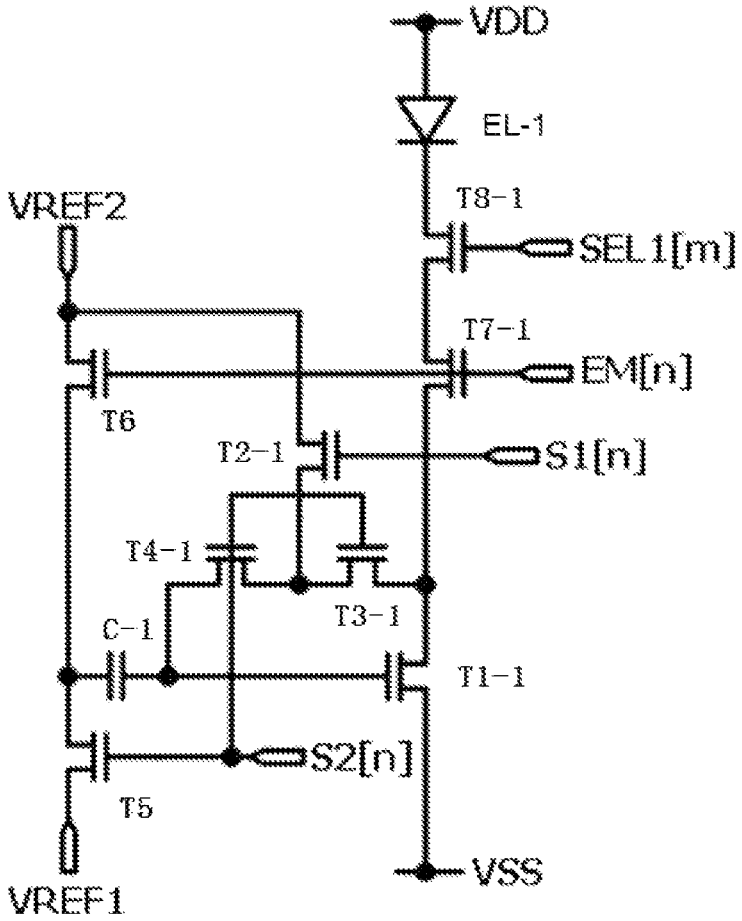
FIG. 6 is a schematic diagram showing the structure of a substrate circuit of the present disclosure.
Figure 8:
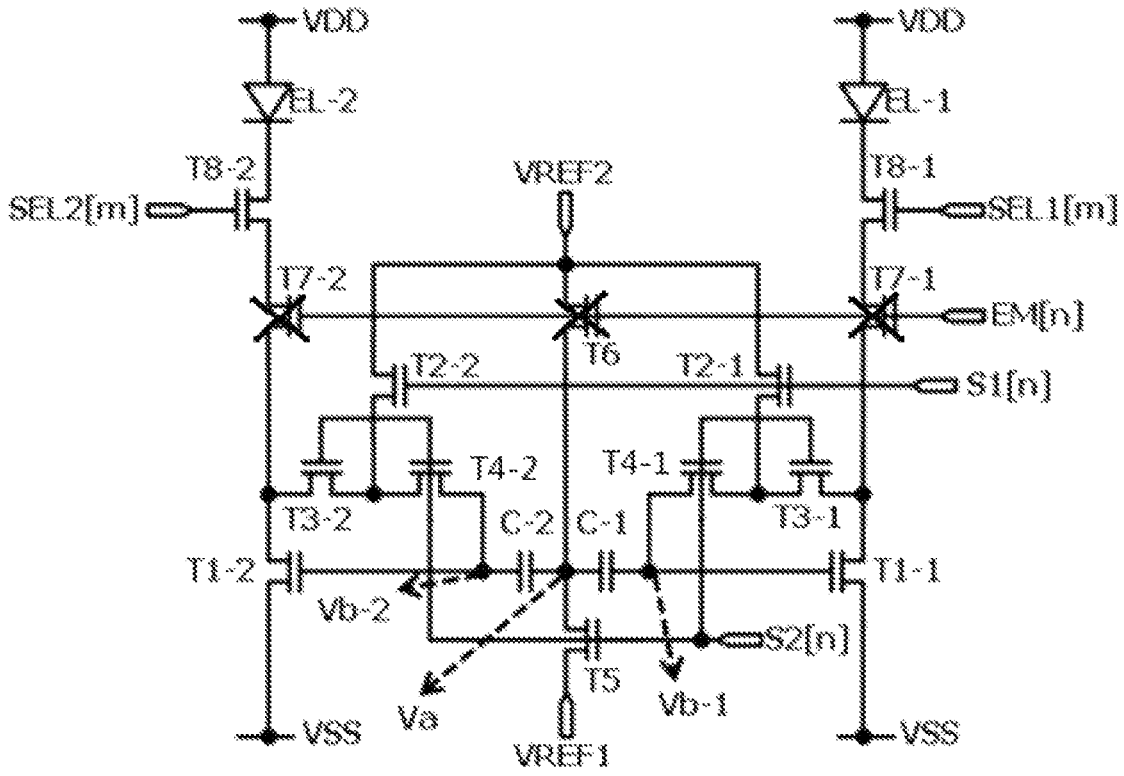
FIG. 8 is a schematic circuit diagram of an initialization stage of a driving circuit of the present disclosure.

Referring to FIGS. 4 and 8, in a further embodiment of one embodiment, the first driving unit 102 includes a first transistor T1-1, the first reset unit 104 includes a second transistor T2-1, the first capacitor unit 103 includes a first capacitor C-1, the substrate circuit 100 further includes a third transistor T3-1, a fourth transistor T4-1, a fifth transistor T5-1, a sixth transistor T6-1, a seventh transistor T7-1, and a eighth transistor T8-1. In one embodiment, a driving circuit included of N-type transistors is illustrated.

With continuing reference to FIGS. 4 and 8, in one embodiment, a first end of the first transistor T1-1 is connected with a cathode of the first light-emitting device EL-1, and a second end of the first transistor T1-1 is connected with a negative electrode of a power supply and used for receiving a negative electrode power supply voltage VSS, the gate of the first transistor T1-1 is connected with the second end of the fourth transistor T4-1 and the first end of the first capacitor C-1. The second end of the first capacitor C-1 is connected with the second capacitor unit 203.

With continued reference to FIGS. 4 and 8, a first end of the second transistor T2-1 is connected with a first reference potential line for receiving a first reference potential VREF2, and a second end of the second transistor T2-1 is connected with a second end of the third transistor T3-1 and a first end of the fourth transistor T4-1, and a gate of the second transistor T2-1 is connected with a first control signal line for receiving the first control signal S1[n], the first control signal is used for controlling the on and off of the second transistor T2-1, the second transistor T2-1 is in an on state when the first control signal is in a high level, and the second transistor T2-1 is in an off state when the first control signal is in a low level. The second transistor T2-1 is connected with the first transistor T1-1 through the third transistor T3-1 and the fourth transistor T4-1, and is used for resetting the first transistor T1-1 according to the first control signal after the second transistor T2-1 receives the first reference potential, that is, pulling up the Vg potential of the first transistor T1-1 for initialization so as to write a subsequent compensation voltage.

With continuing reference to FIGS. 4 and 8, a first end of the third transistor T3-1 is connected with a first end of the first transistor T1-1, a second end of the third transistor T3-1 is connected with a first end of the fourth transistor T4-1, and a second end of the fourth transistor T4-1 is connected with a first end of the first capacitor C-1, the gate of the third transistor T3-1 and the gate of the fourth transistor T4-1 are respectively connected with a second control signal line and used for receiving a second control signal S2[n]. The second control signal is used for controlling the on and off of the third transistor T3-1 and the fourth transistor T4-1, when the second control signal is in a high level, the third transistor T3-1 and the fourth transistor T4-1 are in an on state, and when the second control signal is in a low level, the third transistor T3-1 and the fourth transistor T4-1 are in an off state.

With continued reference to FIGS. 4 and 8, a first end of the fifth transistor T5-1 is connected with a common end of the first capacitor unit 103 and the second capacitor unit 203, and a second end of the fifth transistor T5-1 is connected with a second reference potential line and is used for receiving a second reference potential VREF1, the gate of the fifth transistor T5-1 is connected with the second control signal line and is used for receiving a second control signal S2[n]. The second control signal is used for controlling the on and off of the fifth transistor T5-1, when the second control signal is in a high level, the fifth transistor T5-1 is in an on state, and when the second control signal is in a low level, the fifth transistor T5-1 is in an off state.

With continued reference to FIGS. 4 and 8, a first end of the sixth transistor T6-1 is connected with the first reference potential line and is configured to receive the first reference potential VREF2, and a second end of the sixth transistor T6-1 is connected with a first end of the fifth transistor T5-1 and a second end of the first capacitor C1, the gate of the sixth transistor T6-1 is connected with a third control signal line and is used for receiving a third control signal EM[m]. The third control signal is used for controlling the on and off of the sixth transistor T6-1, the sixth transistor T6-1 is in an on state when the third control signal is in a high level, and the sixth transistor T6-1 is in an off state when the third control signal is in a low level.

With continuing reference to FIGS. 4 and 8, a first end of the seventh transistor T7-1 is connected with a cathode of the first light-emitting device EL-1, and a second end of the seventh transistor T7-1 is connected with a first end of the third transistor T3-1 and a first end of the first transistor T1-1, the gate of the seventh transistor T7-1 is connected with a third control signal line and is used for receiving the third control signal EM[m]. The third control signal is used for controlling the on and off of the seventh transistor T7-1, the seventh transistor T7-1 is in an on state when the third control signal is in a high level, and the seventh transistor T7-1 is in an off state when the third control signal is in a low level.

With continuing reference to FIGS. 4 and 8, a first end of the eighth transistor T8-1 is connected with a cathode of the first light-emitting device EL-1, a second end of the eighth transistor T8-1 is connected with a first end of the seventh transistor T7-1, and a gate of the eighth transistor T8-1 is connected with a fourth control signal line and is used for receiving a fourth control signal SEL[m]. The fourth control signal is used for controlling the on and off of the eighth transistor T8-1, the eighth transistor T8-1 is in an on state when the fourth control signal is in a high level, and the eighth transistor T8-1 is in an off state when the fourth control signal is in a low level.

With continuing reference to FIGS. 4 and 8, the second driving unit 202 includes a ninth transistor T1-2, a first end of the ninth transistor T1-2 is connected with a cathode of the second light-emitting device EL-2, a second end of the ninth transistor T1-2 is connected with a power supply negative electrode VSS, and a gate of the ninth transistor T1-2 is connected with the second capacitor unit 204.

With continuing reference to FIGS. 4 and 8, in particular, the second capacitor unit 203 includes a second capacitor T1-2, a first end of the second capacitor C-2 is connected with a gate of the ninth transistor T1-2, and a second end of the second capacitor C-2 is connected with the first capacitor unit 103.

The second reset unit 204 includes a tenth transistor T2-2, a first end of the tenth transistor T2-2 is connected with the first reference voltage line and used for receiving the first reference voltage VREF2, a second end of the tenth transistor T2-2 is connected with the second driving unit 202, and a gate of the tenth transistor T2-2 is connected with the first control signal line and used for receiving the first control signal. The first control signal is used for controlling the on and off of the tenth transistor T2-2, the tenth transistor T2-2 is in an on state when the first control signal is in a high level, and the tenth transistor T2-2 is in an off state when the first control signal is in a low level.

Further, the standby circuit 200 further includes an eleventh transistor T3-2 and a twelfth transistor T4-2. In the embodiment, the first end of the eleventh transistor T3-2 is connected with a second end of the twelfth transistor T4-2, and a first end of the twelfth transistor T4-2 is connected with the gate of the ninth transistor T1-2 and the first end of the second capacitor C-2, the gate of the eleventh transistor T3-2 and the gate of the twelfth transistor T4-2 are respectively connected with the second control signal line and used for receiving a second control signal. The second control signal is used for controlling on and off of the eleventh transistor T3-2 and the twelfth transistor T4-2, the eleventh transistor T3-2 and the twelfth transistor T4-2 are in an on state when the second control signal is in a high level, and the eleventh transistor T3-2 and the twelfth transistor T4-2 are in an off state when the second control signal is in a low level.

In particular, the tenth transistor T2-2 is connected with the ninth transistor T1-2 through the eleventh transistor T3-2 and the twelfth transistor T4-2, and the tenth transistor T2-2 is used for receiving the first reference potential and resetting the ninth transistor T1-2 according to the first control signal, that is, pulling up the Vg potential of the ninth transistor T1-2 for initialization so as to write a subsequent compensation voltage.

Further, the standby circuit 200 further includes a thirteenth transistor T7-2 and a fourteenth transistor T8-2. Specifically, a first end of the thirteenth transistor T7-2 is connected with a second end of the fourteenth transistor T8-2, a second end of the thirteenth transistor T7-2 is connected with a first end of the ninth transistor T1-2 and a second end of the eleventh transistor T3-2, and a gate of the thirteenth transistor T7-2 is connected the third control signal line and is used for receiving a third control signal, the first end of the fourteenth transistor T8-2 is connected with the cathode of the second light-emitting device EL-2, the gate of the fourteenth transistor T8-2 is connected with a fifth control signal line and is used for receiving a fifth control signal, and the anode of the second light-emitting device EL-2 is connected with the positive electrode of the power supply. In the embodiment, the third control signal line is used for controlling the on and off of the thirteenth transistor T7-2, and the fifth control signal is used for controlling the on and off of the fourteenth transistor T8-2. Wherein the fourteenth transistor T8-2 is a time controller for controlling the current to pass through the EL-2 device and corresponds to the luminating brightness and the gray scale.

For a further understanding of the manner in which the driving circuit of the present disclosure operates, reference is made to FIGS. 8-13.

Figure 9:
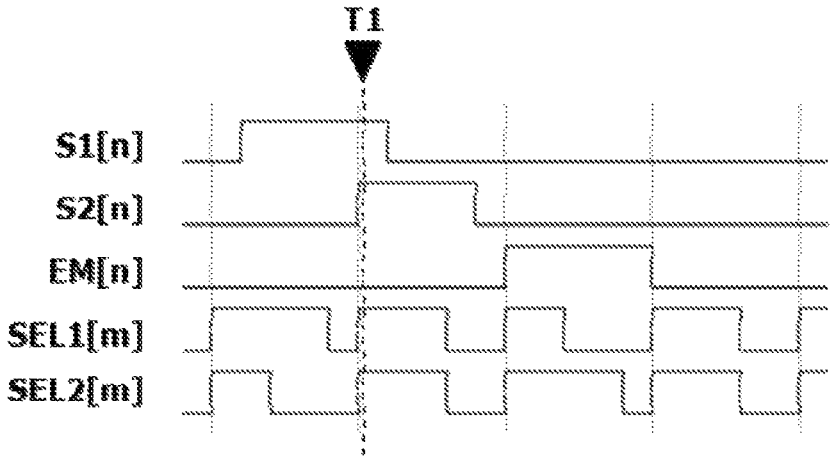
FIG. 9 is a schematic diagram of a control waveform of the initialization stage of a driving circuit of the present disclosure.

As shown in FIG. 9, in a scanning time corresponding to a column of pixel units, a first-time interval T1 is included, and the operation and the state of each signal and original in the first-time interval T1 are described in conjunction with FIGS. 8 and 9. It should be noted that the following control timing is exemplified by the transistor being an N-type transistor, which may also be a P-type transistor.

Figure 7:
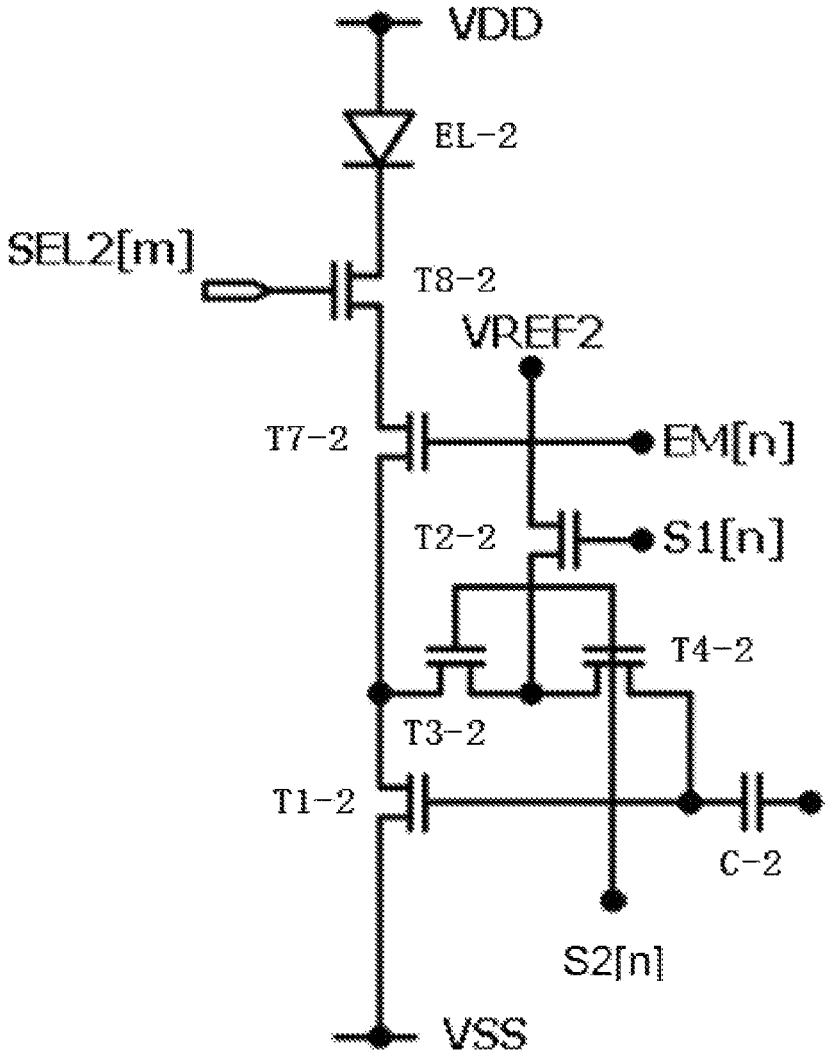
FIG. 7 is a schematic diagram showing the structure of a standby circuit of the present disclosure.

The first-time interval T1 is an initialization time interval of the driving circuit. In the first-time interval T1, the first control signal S1[n] is in a high level, the second control signal S2[n] is in a high level, the third control signal EM[n] is in a low level, the fourth control signal SEL1 [m] is in a high level, and the fifth control signal SEL2[m] is in a high level. It should be noted that "X" in FIG. 7 is shown in an off state.

At this time, the second transistor T2-1 and the tenth transistor T2-2 will be turned on by the high-level first control signal S1[n]. In particular, the gate end of the tenth transistor T2-1 is connected with a high-level first control signal S1[n] and is transmitted to the gate of the first transistor T1-1 through the second end of the fourth transistor T4-1, the gate potential Vg of the first transistor T1-1 is pulled high, and the first transistor T1-1 is initialized for subsequent writing of the compensation voltage, that is receiving the first reference potential VREF2 via the first end of the second transistor T2-1, and transferring the first reference potential VREF2 to the gate of the first transistor T1-1 via the second end of the fourth transistor T4-1, the initialization principle of the tenth transistor T1-2 is, likewise, the same as the second transistor T1-1. More specifically, it can be represented by the following formula: Vb-1=Vb-2=VREF2.

The fifth transistor T5-1 will be turned on by the high-level second control signal S2[n]. Specifically, the second end of the fifth transistor T5-1 receives a second reference potential VREF1 and pulls up the first end of the fifth transistor T5-1 to the second reference potential VREF1 for adjusting the magnitude of the current output. More specifically, it can be represented by the following formula: Va=VREF1. In the present disclosure, the first-time interval T1 is used as the initialization program before the circuit function operation, so as to avoid the signal of the previous time sequence being left over and affecting the current time sequence operation.

Figure 10:
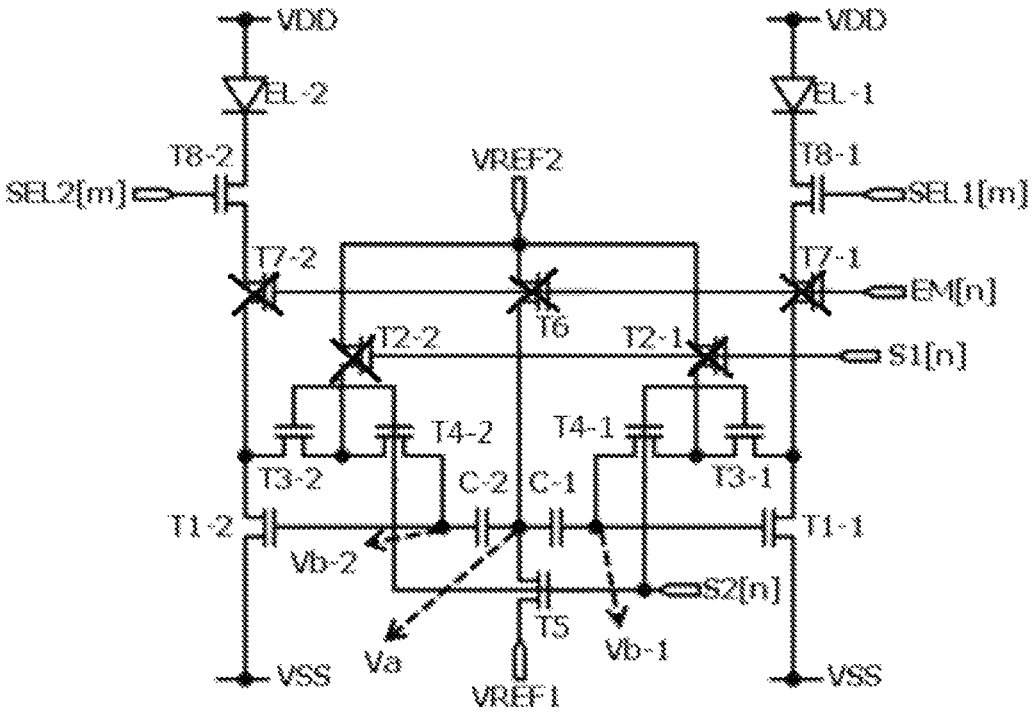
FIG. 10 is a schematic circuit diagram of the compensation stage of the driving circuit of the present disclosure.
Figure 11:
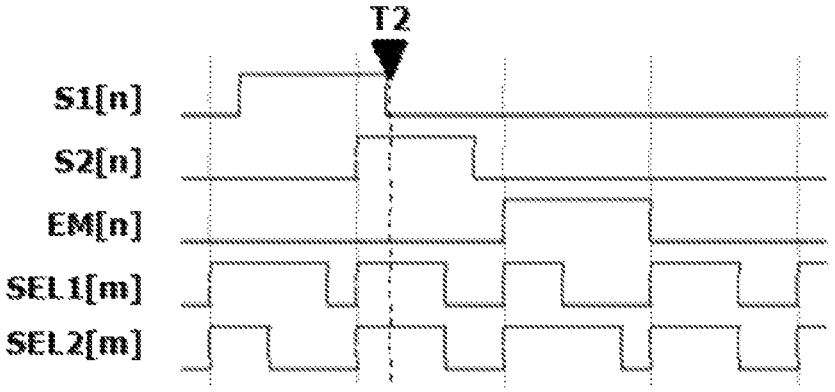
FIG. 11 is a schematic diagram of a control waveform of the initialization stage of a driving circuit of the present disclosure.

Further, referring to FIG. 11, a first-time interval T2 is included in a scanning time corresponding to a column of pixel units, and operations and states of signals and originals in the second time interval T2 are described in conjunction with FIGS. 10 and 11. The second time interval T2 is the voltage compensation phase of the driving circuit. In the second time interval T2, the first control signal S1[n] is in a low level, the second control signal S2[n] is in a high level, the third control signal EM[n] is in a low level, the fourth control signal SEL1[m] is in a high level, and the fifth control signal SEL2[m] is in a high level.

After initializing the first transistor T1-1 and the ninth transistor T1-2, the power supply negative electrode voltage VSS charges the first capacitor C1 through the paths of the first transistor T1-1, the third transistor T3-1, and the fourth transistor T4-1 until the voltage Vg of the gate of the first transistor T1-1 reaches the threshold voltage |Vth1| then stops. Similarly, the charging principle of the second capacitor C2 is identical to that of the first capacitor C1. Specifically, it can be represented by the following formula: Vb-1=VSS+|Vth1|, that is, the power supply negative electrode voltage VSS discharges the first capacitor C1 to meet the threshold voltage |Vth1| voltage difference of the first transistor T1-1, and Vb-2=VSS+|Vth2|, that is, the power supply negative electrode voltage VSS discharges the second capacitor C2 to meet the |Vth2| voltage difference of T1-2. Wherein the voltage Va=VREF1: at the first end of the fifth transistor T5-1 is the same as the voltage in the first-time interval T1. In the embodiment, the second transistor T2-1 is off because the first control signal S1[n] is in a low level. The seventh transistor T7-1 and the sixth transistor T6 are off because the third control signal EM[n] is in a low level.

Figure 12:
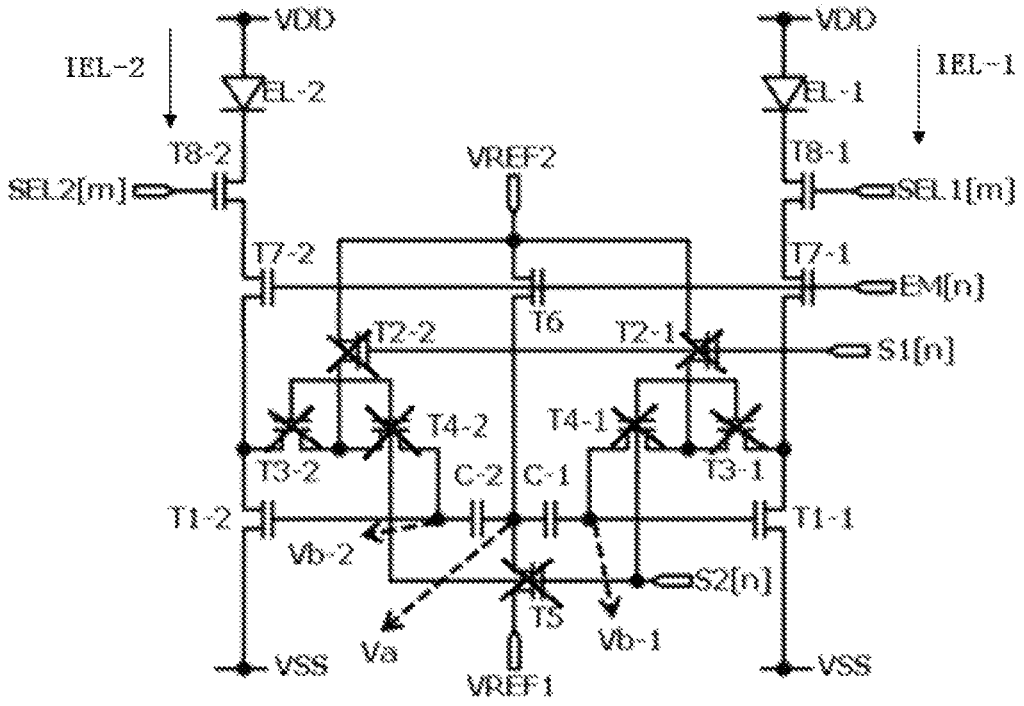
FIG. 12 is a schematic circuit diagram of an output stage of a driving circuit of the present disclosure.
Figure 13:
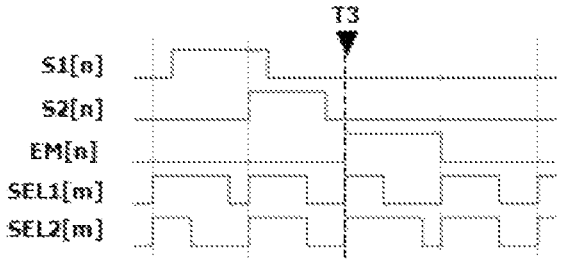
FIG. 13 is a schematic diagram of a control waveform at the output stage of the driving circuit of the present disclosure.

Further, referring to FIG. 12, a first-time interval T3 is included in a scanning time corresponding to a column of pixel units, and the operation and state of each signal and element in the third time interval T3 will be described in conjunction with FIG. 12 and FIG. 13. The third time interval T3 is an output stage, in the third time interval T3 stage, the first control signal S1[n] is in a low level, the second control signal S2[n] is in a low level, the third control signal EM[n] is in a high level, the fourth control signal SEL1[m] is in a high level, and the fifth control signal SEL2[m] is in a high level.

At this time, the sixth transistor T6, the seventh transistor T7-1 are turned on by the high-level third control signal EM[n], and the eighth transistor T8-1 is turned on by the high-level fourth control signal SEL1[m]. The second transistor T2-1 is turned off due to the low-level first control signal S1[n], so that the third transistor T3-1 and the fourth transistor T4-1 connected with the second transistor T2-1 are turned off, and the fifth transistor T5-1 is turned off due to the low-level second control signal S2[n]. A first end of the sixth transistor T6 receives a first reference voltage VREF2 and is coupled to a gate of the first transistor T1-1 via a first capacitor C-1. More specifically, it can be expressed by the following expression: Vb-1=VSS+|Vth1|+(VREF2−VREF1), Vb-1 represents the compensation voltage value of the final output of the substrate circuit, Vb-2=VSS+|Vth2|+(VREF2−VREF1) can be obtained by the same reasoning, and Vb-2 is the compensation voltage value of the final output of the standby circuit; Va=VREF2, Va representing that coupling the voltage difference between the second reference voltage VREF1 and the first reference voltage VREF2 to the first transistor T1-1 through the first capacitor C-1. Wherein The equivalent formula of the output current is as follows:

$$I_{EL}-1=I_{EL}-2=kx(Vb-VSS-Vth)^2=kx(\mathrm{VREF1}-\mathrm{VREF2})^2$$

And k is a conductivity coefficient, and the above formula does not have a parameter factor of the positive electrode power supply voltage VDD, so that the compensation current output is not influenced by the voltage drop of the positive electrode power supply voltage VDD. Therefore, by writing the first reference voltage VREF2 into the first transistor T1-1, the first transistor T1-1 obtains an adjustable trans-voltage for compensating a positive electrode power supply voltage VDD voltage drop caused by a voltage drop effect, the first transistor T1-1 outputs a stable current and the stable current reaches the eighth transistor T8-1 after passing through the seventh transistor T7-1; the eighth transistor T8-1 serves as a time controller for controlling the passage of the current, corresponding to the illuminating brightness and the gray level.

Figure 14:
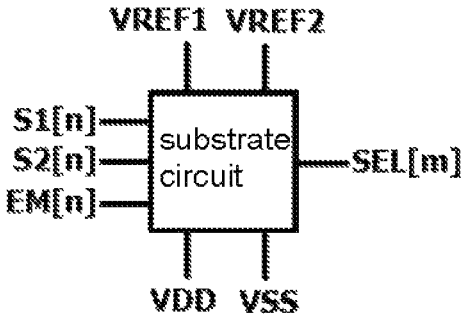
FIG. 14 is an equivalent schematic diagram of the driving circuit of the present disclosure.
Figure 15:
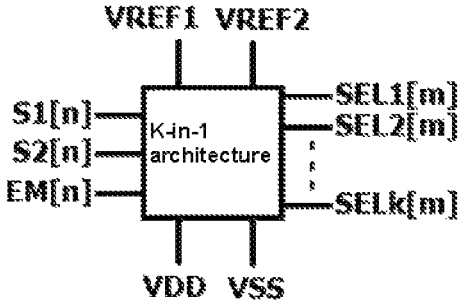
FIG. 15 is an equivalent schematic diagram of a substrate circuit connecting a plurality of standby circuits in the present disclosure.
Figure 16:
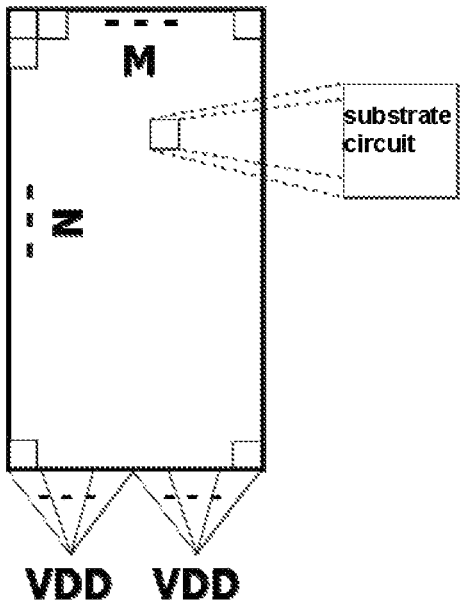
FIG. 16 is a schematic diagram showing a layout of pixel points when a substrate circuit connecting a plurality of standby circuits in the present disclosure.

Referring to FIGS. 14, 15 and 16, in a further embodiment of one embodiment, a 2-in-1 architecture can be achieved by adding circuit to the original substrate circuit (pixel compensation circuit architecture) to simultaneously drive two EL devices within a pixel to avoid the problem of charging time degradation due to resolution increase. Similarly, if there are k −1 standby circuits on the substrate circuit (base pixel circuit structure), a k-in-1 pixel structure can be achieved, the k EL devices can be driven synchronously, and the resolution specification upper limit is increased. Thus, if more than two light-emitting devices need to be synchronously controlled, more than two standby circuits can be coupled on a circuit basis, among them, SEL1[m] is the output of a standby circuit coupled to the substrate circuit, and SEL2[m] is the output of two standby circuits couple to the substrate circuit, and so on. It is easy to understand that more standby circuits are coupled, more light-emitting devices can be synchronously controlled, the synchronously controlled light-emitting devices can emit light of the same color or different colors under time sequence control, voltage compensation can be carried out according to the substrate circuit, and the display effect is improved under the condition of ensuring resolution.

Figure 17:
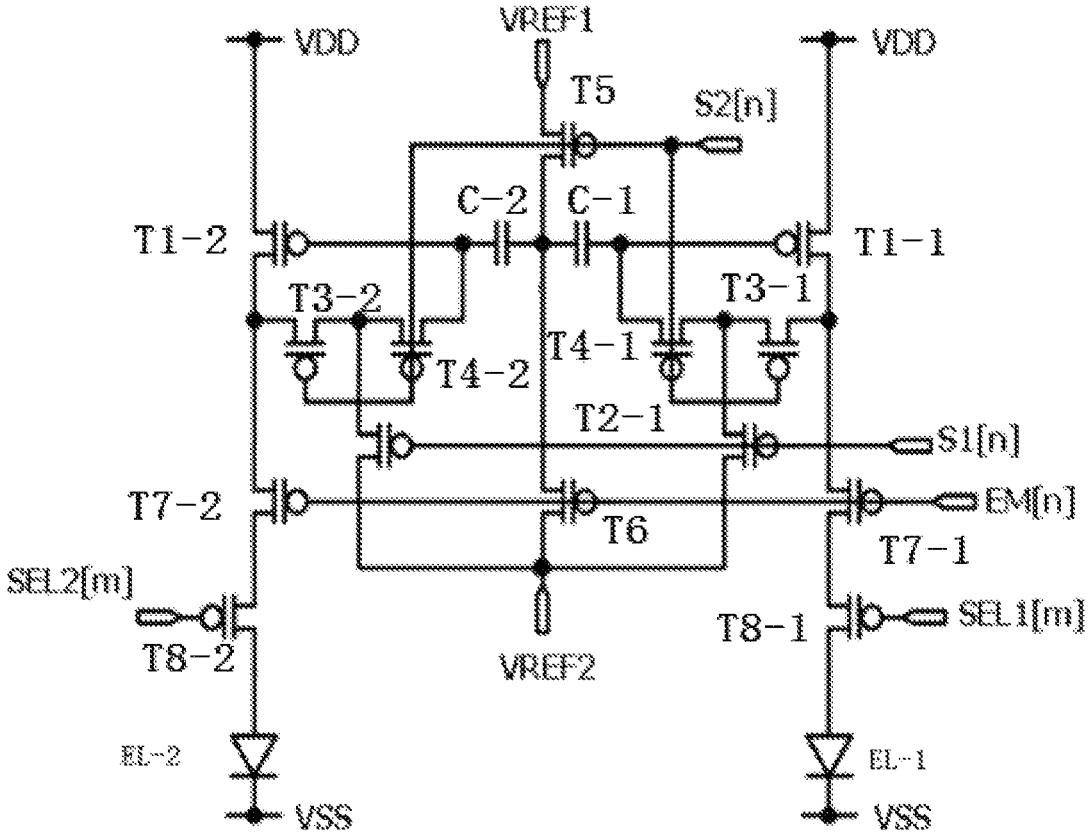
FIG. 17 is a schematic view showing the structure of another embodiment of the driving circuit of the present disclosure.

Referring to FIG. 17, the present disclosure also provides an embodiment of a driving circuit composed of P-type transistors, the principle of which is identical to that of the driving circuit composed of N-type transistors and will not be described in detail herein.

The disclosure also provides a display apparatus, the display apparatus includes a display panel and the driving circuit, wherein the driving circuit is arranged on the display panel. The driving circuit includes a substrate circuit and standby circuits, wherein the standby circuits are connected with the substrate circuit; the standby circuit is connected with a second light-emitting device, and the substrate circuit synchronously controls the first light-emitting device and the second light-emitting device. In particular, as described above, a detailed description thereof will not be repeated herein.

In summary, in the driving circuit and the display apparatus provided by the disclosure, synchronous driving of a plurality of light-emitting devices can be realized through accumulating standby circuit on the basis of the compensation of the light-emitting devices. Therefore, the present disclosure improves the brightness uniformity caused by the voltage drop to improve the picture quality of the display, and can simultaneously control the light emission of multiple light-emitting devices, under the same charging time, the driving feasibility of the display resolution is improved, so as to improve the resolution of the display.

It is to be understood that the disclosure is not limited in its application to the examples described above and that modifications and variations may be resorted to in light of the above teachings by those skilled in the art, all falling within the scope of the appended claims.

What is claimed is:

1. A driving circuit, comprising a substrate circuit and at least one standby circuit connected with the substrate circuit; wherein the substrate circuit comprises a first light-emitting device, a first driving unit and a first capacitor unit; the first driving unit is respectively connected with the first light-emitting device and the first capacitor unit; the first capacitor unit is charged through the first driving unit until a voltage value of the first capacitor unit meets a compensation voltage value of the first driving unit; after the charging of the first capacitor unit is completed, a first reference potential is coupled with the first capacitor unit to enable the first driving unit to obtain a first adjustable trans-voltage, and the first driving unit outputs a stable current according to the first adjustable trans-voltage to drive the first light-emitting device to work;

the standby circuit comprises a second light-emitting device, a second driving unit and a second capacitor unit, and the second light-emitting device is respectively connected with the second driving unit and the second capacitor unit; the second capacitor unit is connected with the first capacitor unit; the second capacitor unit is charged through the second driving unit until a voltage value of the second capacitor unit meets a compensation voltage value of the second driving unit; after the charging of the second capacitor unit is completed, the first reference potential is coupled with the second capacitor unit to enable the second driving unit to obtain a second adjustable trans-voltage, and the second driving unit outputs a stable current according to the second adjustable trans-voltage to drive the second light-emitting device to work;

the substrate circuit further comprises a third transistor and a fourth transistor; a first end of the third transistor is connected with the first driving unit, the second end of the third transistor is connected with a first end of the fourth transistor, a second end of the fourth transistor is connected with the first capacitor unit, and a gate of the third transistor and a gate of the fourth transistor are respectively connected with a second control signal line and used for receiving a second control signal;

the substrate circuit further comprises a fifth transistor, a first end of the fifth transistor is connected with the first capacitor unit and the second capacitor unit, a second end of the fifth transistor is connected with a second reference potential line and used for receiving a second reference potential, and a gate of the fifth transistor is connected with the second control signal line and used for receiving the second control signal.

2. The driving circuit according to claim 1, wherein the first driving unit comprises a first transistor, a first end of the first transistor is connected with a cathode of the first light-emitting device, a second end of the first transistor is connected with a negative electrode of a power supply, and a gate of the first transistor is connected with the first capacitor unit.

3. The driving circuit according to claim 2, wherein the first capacitor unit comprises a first capacitor, a first end of the first capacitor is connected with the gate of the first transistor, and a second end of the first capacitor is connected with the second capacitor unit.

4. The driving circuit according to claim 1, wherein the substrate circuit further comprises a first reset unit, the first reset unit is connected with the first driving unit and is configured to receive the first reference potential and reset the first driving unit according to a first control signal.

5. The driving circuit according to claim 4, wherein the first reset unit comprises a second transistor, a first end of the second transistor is connected with a first reference potential line and used for receiving the first reference potential, a second end of the second transistor is connected with the first driving unit, and a gate of the second transistor is connected with a first control signal line and used for receiving the first control signal.

6. The driving circuit according to claim 1, wherein the substrate circuit further comprises a sixth transistor and a seventh transistor; a first end of the sixth transistor is connected with a first reference potential line and used for receiving the first reference potential, a second end of the sixth transistor is connected with the first end of the fifth transistor and the first capacitor unit, and a gate of the sixth transistor is connected with a third control signal line and used for receiving a third control signal; a first end of the seventh transistor is connected with a cathode of the first light-emitting device, a second end of the seventh transistor is connected with the first end of the third transistor and the first driving unit, and a gate of the seventh transistor is connected with the third control signal line and used for receiving the third control signal.

7. The driving circuit according to claim 1, wherein the substrate circuit further comprises an eighth transistor, a first end of the eighth transistor is connected with a cathode of the first light-emitting device, a second end of the eighth transistor is connected with the first driving unit, and a gate of the eighth transistor is connected with a fourth control signal line and is used for receiving a fourth control signal.

8. The driving circuit according to claim 1, wherein the second driving unit comprises a ninth transistor, a first end of the ninth transistor is connected with a cathode of the second light-emitting device, a second end of the ninth transistor is connected with a negative electrode of a power supply, and a gate of the ninth transistor is connected with the second capacitor unit.

9. The driving circuit according to claim 8, wherein the second capacitor unit comprises a second capacitor, a first end of the second capacitor is connected with the gate of the ninth transistor, and a second end of the second capacitor is connected with the first capacitor unit.

10. The driving circuit according to claim 8, wherein the standby circuit further comprises an eleventh transistor and a twelfth transistor; wherein a first end of the eleventh transistor is connected with a second end of the twelfth transistor, a first end of the twelfth transistor is respectively connected with the second driving unit and the second capacitor unit, and a gate of the eleventh transistor and a gate of the twelfth transistor are respectively connected with a second control signal line and used for receiving a second control signal.

11. The driving circuit according to claim 10, wherein the standby circuit further comprises a thirteenth transistor and a fourteenth transistor; a first end of the thirteenth transistor is connected with a second end of the fourteenth transistor, a second end of the thirteenth transistor is connected with the first end of the ninth transistor and the second end of the eleventh transistor, a gate of the thirteenth transistor is connected with a third control signal line and is used for receiving a third control signal, and the first end of the fourteenth transistor is connected with the cathode of the second light-emitting device; a gate of the fourteenth transistor is connected with a fifth control signal line and used for receiving a fifth control signal, and an anode of the second light-emitting device is connected with a positive electrode of the power supply.

12. The driving circuit according to claim 1, wherein the standby circuit further comprises a second reset unit, the second reset unit is connected with the second driving unit and the second reset unit is used for receiving the first reference potential and resetting the second driving unit according to a first control signal.

13. The driving circuit according to claim 12, wherein the second reset unit comprises a tenth transistor, a first end of the tenth transistor is connected with a first reference voltage line and used for receiving a first reference voltage, a second end of the tenth transistor is connected with the second driving unit, and a gate of the tenth transistor is connected with a first control signal line and used for receiving a first control signal.

14. A display apparatus, comprising a display panel and a driving circuit, the driving circuit being arranged on the display panel;

wherein the driving circuit comprises a substrate circuit and at least one standby circuit connected with the substrate circuit; wherein the substrate circuit comprises a first light-emitting device, a first driving unit and a first capacitor unit; the first driving unit is respectively connected with the first light-emitting device and the first capacitor unit; the first capacitor unit is charged through the first driving unit until a voltage value of the first capacitor unit meets a compensation voltage value of the first driving unit; after the charging of the first capacitor unit is completed, a first reference potential is coupled with the first capacitor unit to enable the first driving unit to obtain a first adjustable trans-voltage, and the first driving unit outputs a stable current according to the first adjustable trans-voltage to drive the first light-emitting device to work; the standby circuit comprises a second light-emitting device, a second driving unit and a second capacitor unit, and the second light-emitting device is respectively connected with the second driving unit and the second capacitor unit; the second capacitor unit is connected with the first capacitor unit; the second capacitor unit is charged through the second driving unit until a voltage value of the second capacitor unit meets a compensation voltage value of the second driving unit; after the charging of the second capacitor unit is completed, the first reference potential is coupled with the second capacitor unit to enable the second driving unit to obtain a second adjustable trans-voltage, and the second driving unit outputs a stable current according to the second adjustable trans-voltage to drive the second light-emitting device to work;

the substrate circuit further comprises a third transistor and a fourth transistor; a first end of the third transistor is connected with the first driving unit, the second end of the third transistor is connected with a first end of the fourth transistor, a second end of the fourth transistor is connected with the first capacitor unit, and a gate of the third transistor and a gate of the fourth transistor are respectively connected with a second control signal line and used for receiving a second control signal;

the substrate circuit further comprises a fifth transistor, a first end of the fifth transistor is connected with the first capacitor unit and the second capacitor unit, a second end of the fifth transistor is connected with a second reference potential line and used for receiving a second reference potential, and a gate of the fifth transistor is connected with the second control signal line and used for receiving the second control signal.

15. The display apparatus according to claim 14, wherein the first driving unit comprises a first transistor, a first end of the first transistor is connected with a cathode of the first light-emitting device, a second end of the first transistor is connected with a negative electrode of a power supply, and a gate of the first transistor is connected with the first capacitor unit.

16. The display apparatus according to claim 15, wherein the first capacitor unit comprises a first capacitor, a first end of the first capacitor is connected with the gate of the first transistor, and a second end of the first capacitor is connected with the second capacitor unit.

17. The display apparatus according to claim 14, wherein the substrate circuit further comprises a first reset unit, the first reset unit is connected with the first driving unit and is configured to receive the first reference potential and reset the first driving unit according to a first control signal.

18. The display apparatus according to claim 17, wherein the first reset unit comprises a second transistor, a first end of the second transistor is connected with a first reference potential line and used for receiving the first reference potential, a second end of the second transistor is connected with the first driving unit, and a gate of the second transistor is connected with a first control signal line and used for receiving the first control signal.

* * * * *